United States Patent [19]

Grill et al.

[11] 4,049,236

[45] Sept. 20, 1977

[54] TOOL FOR REMOVING STAPLES

[76] Inventors: Carl E. Grill, 1432 E. Second St.; Phillip M. Levi, Jr., 2600 Knollwood, both of Casper, Wyo. 82601

[21] Appl. No.: 739,260

[22] Filed: Nov. 5, 1976

[51] Int. Cl.[2] ..... B25C 11/00

[52] U.S. Cl. ..... 254/28

[58] Field of Search ..... 254/28

[56] References Cited

U.S. PATENT DOCUMENTS

| | | | |
|---|---|---|---|
| 3,698,689 | 10/1972 | Poskin | 254/28 |
| 3,825,226 | 7/1974 | Appleman | 254/28 |

*Primary Examiner*—Al Lawrence Smith
*Assistant Examiner*—Robert C. Watson
*Attorney, Agent, or Firm*—Scrivener, Parker, Scrivener and Clarke

[57] ABSTRACT

A tool for removing U-shaped wire staples has a handle and an elongated rod-like tool which has a pointed lower part for positioning adjacent the bridge of a staple with embedded legs, a horizontal slot above the pointed end for receiving the bridge of the staple, and an upper part for stabilizing the bridge when it is received within the slot. The handle is aligned with the tool so that the rear end of the handle may be struck, forcing the bridge into the slot in a jam-fit grasp and driving the legs of the staple from the material holding them.

1 Claim, 2 Drawing Figures

TOOL FOR REMOVING STAPLES

BACKGROUND OF THE INVENTION

1. Field of the Invention

The invention relates broadly to the art of removing U-shaped staples the legs of which are driven through the material to be fastened and into base material and may, or may not, be bent in fastened position, such staples being widely used in the field and art of upholstering. More particularly, the invention has to do with staple removers of the rod type, by which is meant an elongated rigid device having a handle at one end and means at the other end for engaging the bridge of the staple in the operation of the tool.

2. Description of the Prior Art

The prior art discloses rod type staple extractors of the type described, one disclosure being in U.S. Letters Pat. to Poskin, No. 3,698,689.

SUMMARY OF THE INVENTION

In the rod type staple extractor provided by the invention the staple engaging part has a pointed lower part defined by curved forwardly converging side edges and an upwardly and rearwardly inclined forward surface, and an upper part separated from the lower part by a horizontal rearwardly extending slot within which the bridge of the staple is received in the removing operation, the upper part also having curved forwardly converging side edges, and the forward transverse edge of the upper part being positioned rearwardly of the pointed forward end of the lower part.

DESCRIPTION OF THE PREFERRED EMBODIMENT

Figure 1:
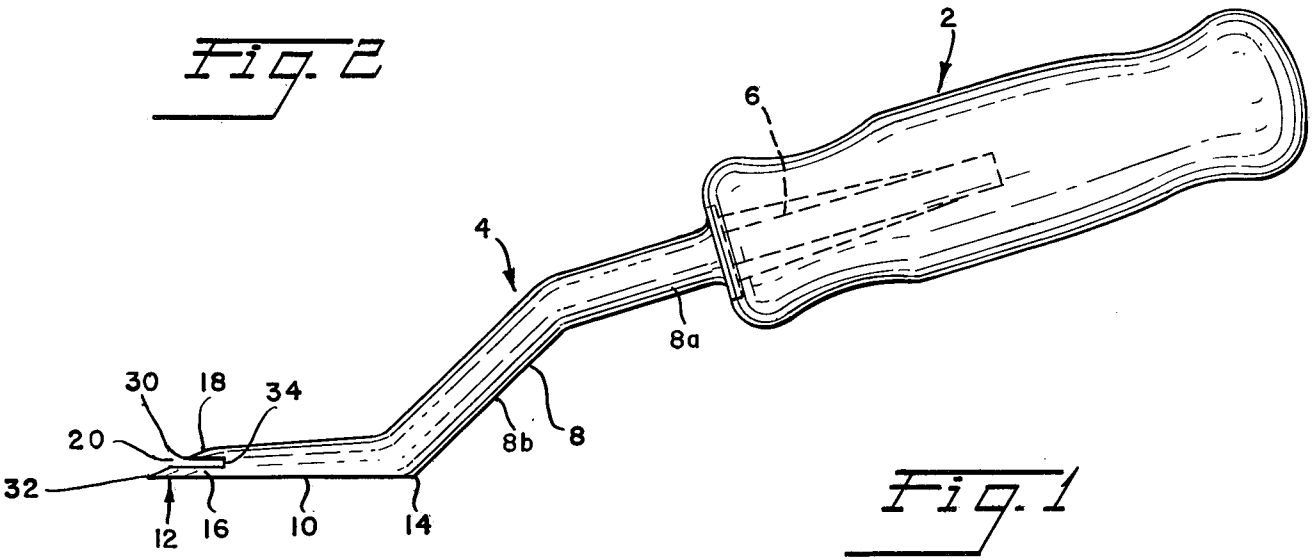
FIG. 1 is a side elevational view of the staple remover provided by the invention.
Figure 2:
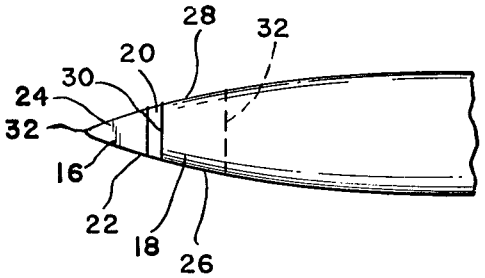
FIG. 2 is an enlarged top plan view of the staple-engaging end of the remover.

The staple remover disclosed in this specification comprises a handle part 2 which is of generally cylindrical shape, and a tool part 4 which is integrally formed from a rod made of steel or other strong and rigid material. The tool part extedns in a generally axial direction from the handle and is connected to the nandle by a part 6 which is driven axially into the handle part 2.

The tool part 4 is a rigid preferably metal rod 8 which has a first **8*a* adjacent the handle and a second part 8*b*, these parts being connected to an obtuse angle the apex of which points upwardly whereby this part of the tool is upwardly bowed. At its distal end the part 8*b* has a straight outer end part 10 which is known as the blade and which forms an obtuse angle with the part 8*b*, the apex of the angle pointing downwardly. The distal end of the blade is indicated at 12** and forms the work part of the tool, which is the part which directly engages and holds the bridge of the staple which is to be removed.

The work part 12 of the tool at the forward or distal end of the blade 10 is constructed and adapted to engage the bridge of a staple which is to be removed. This part comprises a lower part 16, an upper part 18 and a horizontal slot 20 which lies between and is defined by the parts 16 and 18. The lower part 16 of the work part has curved and forwardly converging side edges 22, 24 and the upper part 18 has correspondingly curved and forwardly converging side edges 26, 28, which extend rearwardly from the transverse leading edge 30 of the upper part 18. The forward surfaces of the upper and lower parts 16, 18 are rearwardly inclined and aligned surfaces, and in the lower part 16 this surface forms a sharp leading edge 32 at the plane of the lower surface of the blade. The horizontal slot 20 which lies between the upper and lower parts 16, 18 extends a substantial distance into the blade part 10 and is of sufficient height that it will receive the bridge part of any of a wide range of staples made of wire of various sizes, and extends rearwardly into the body of the blade part 10 by a substantial distance to bottom 34 so that the bridge of any staple to be removed will be stabilized when the tool is operated.

In the use of the tool the lower surface of the blade 10 is placed with the forward edge 32 of the lower part 16 adjacent the bridge of the staple to be removed, in which position the handle part 2 and the arcuate part 8 of the tool extend upwardly from the blade 10 at an obtuse angle so that the handle part is substantially above any obstruction. The outer end of the handle is now rapped with a mallet, forcing both legs of the staple from their purchase and removing the staple.

While one method of removing a staple has been described in this specification, other methods of using the device to remove a staple may be followed. For example, the lower part of the removing device may be engaged beneath the bridge of a staple having one leg loose and one embedded, after which the device may be twisted to remove the staple. In addition, the device may be used to pry out an embedded staple.

We claim:

1. A staple remover comprising a. a generally cylindrical handle, b. a unitary shank projecting axially from the handle and having a part adjacent the handle which is upwardly bowed between its ends, a blade part formed as a forward extension of the bowed part of the shank and forming an obtuse angle therewith, and having a lower surface, the entire lower surface of the blade part extending in a straight line from the obtuse angle area to lie flat on a surface in which a staple is embedded, and c. a work part forming the forward end of the blade part having a surface at its distal end, and comprising i. Spaced lower and upper jaws separated by a horizontal slot which extends rearwardly from the distal end of the work part entirely across the work part and is of sufficient height to receive the bridge of a staple, ii. The lower jaw having curved side edges which converge to a point at the distal end of the lower jaw and having an upwardly and rearwardly inclined upper surface extending from the lower surface of the distal end of the blade part to the slot and forming with the flat lower surface of the blade part a sharp leading edge point, iii. The upper jaw terminating at its distal end in a sharp transverse edge positioned rearwardly of the forward end of the lower jaw and forwardly of the bottom of the slot, and iv. The upper jaw having an upwardly and rearwardly inclined upper surface at its distal end which is aligned with the upper surface of the lower jaw.

* * * * *